US007143808B2

(12) United States Patent
Lee

(10) Patent No.: US 7,143,808 B2
(45) Date of Patent: Dec. 5, 2006

(54) INTAKE OR EXHAUST PORT MOLDING CORE STRUCTURE

(75) Inventor: Bong Sang Lee, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/010,012

(22) Filed: Dec. 10, 2004

(65) Prior Publication Data

US 2005/0235477 A1 Oct. 27, 2005

(30) Foreign Application Priority Data

Apr. 23, 2004 (KR) ..... 10-2004-0028190

(51) Int. Cl.
*B22C 9/10* (2006.01)

(52) U.S. Cl. ..... 164/369

(58) Field of Classification Search ..... 164/369; 428/172, 76, 137, 148
See application file for complete search history.

(56) References Cited

U.S. PATENT DOCUMENTS 5,260,116 A * 11/1993 Hamanaka et al. ..... 428/172
2003/0150431 A1* 8/2003 Oota ..... 123/506

FOREIGN PATENT DOCUMENTS

DE 26 17 938 * 4/1976
JP 2003-035197 2/2000

* cited by examiner

*Primary Examiner*—Len Tran
(74) *Attorney, Agent, or Firm*—Morgan Lewis & Bockius LLP

(57) ABSTRACT

An intake or exhaust port molding core of a cylinder head includes a plurality of protruders on the core to form a plurality of depressed grooves in the intake or exhaust port during casting of the cylinder head. The disposition and orientation of the intake or exhaust port formed inside the cylinder head can then be easily and precisely measured via the depressed grooves.

12 Claims, 3 Drawing Sheets

INTAKE OR EXHAUST PORT MOLDING CORE STRUCTURE

CROSS-REFERENCE TO RELATED APPLICATION(S)

The present application is based on, and claims priority from, Korean Application Serial Number 10-2004-0028190, filed on Apr. 23, 2004, the disclosure of which is hereby incorporated by reference herein in its entirety.

TECHNICAL FIELD OF THE INVENTION

Generally, the present invention relates to an intake or exhaust port molding core structure. More particularly, the core structure is disposed in a cylinder head mold to form an intake or exhaust port in a cylinder head during casting of the cylinder head.

BACKGROUND OF THE INVENTION

Typically, the disposition of the intake or exhaust port in the cylinder head largely affects the engine output. Therefore, the engine efficiency can vary more than or equal to 10% based on the disposition of the intake or exhaust port. Accordingly, it is important that the intake or exhaust port is accurately formed at a designated place in the cylinder head.

For measuring the disposition of the intake or exhaust port of the cylinder head, the cylinder head is typically cut off, then the size of each portion of the intake or exhaust port is measured. The cylinder head is conventionally cut off by using a wire cutting or sawing machine. Next, the exposed intake or exhaust port is measured by using a three-dimensional instrument or scanning device. However, there is a drawback in that cutting the cylinder head complicates the working procedure and the cut-off cylinder head cannot be re-used.

SUMMARY OF THE INVENTION

An embodiment of the present invention is provided to easily and accurately recognize the disposition of the intake or exhaust port formed in the cylinder head without damaging the cylinder head.

An intake or exhaust port molding core structure includes a main body connecting to an intake or exhaust manifold in the cylinder head mold. A subsidiary body extends from the main body and is positioned to connect with the engine combustion chamber in the cylinder head mold. One or more protruders uniformly protrude out on the surface of the main body and subsidiary body in close proximity to their distal ends, respectively.

BRIEF DESCRIPTION OF THE DRAWINGS

For a better understanding of the nature and objects of the present invention, reference should be made to the following detailed description with the accompanying drawings, in which.

DETAILED DESCRIPTION OF PREFERRED EMBODIMENTS

Figure 1:
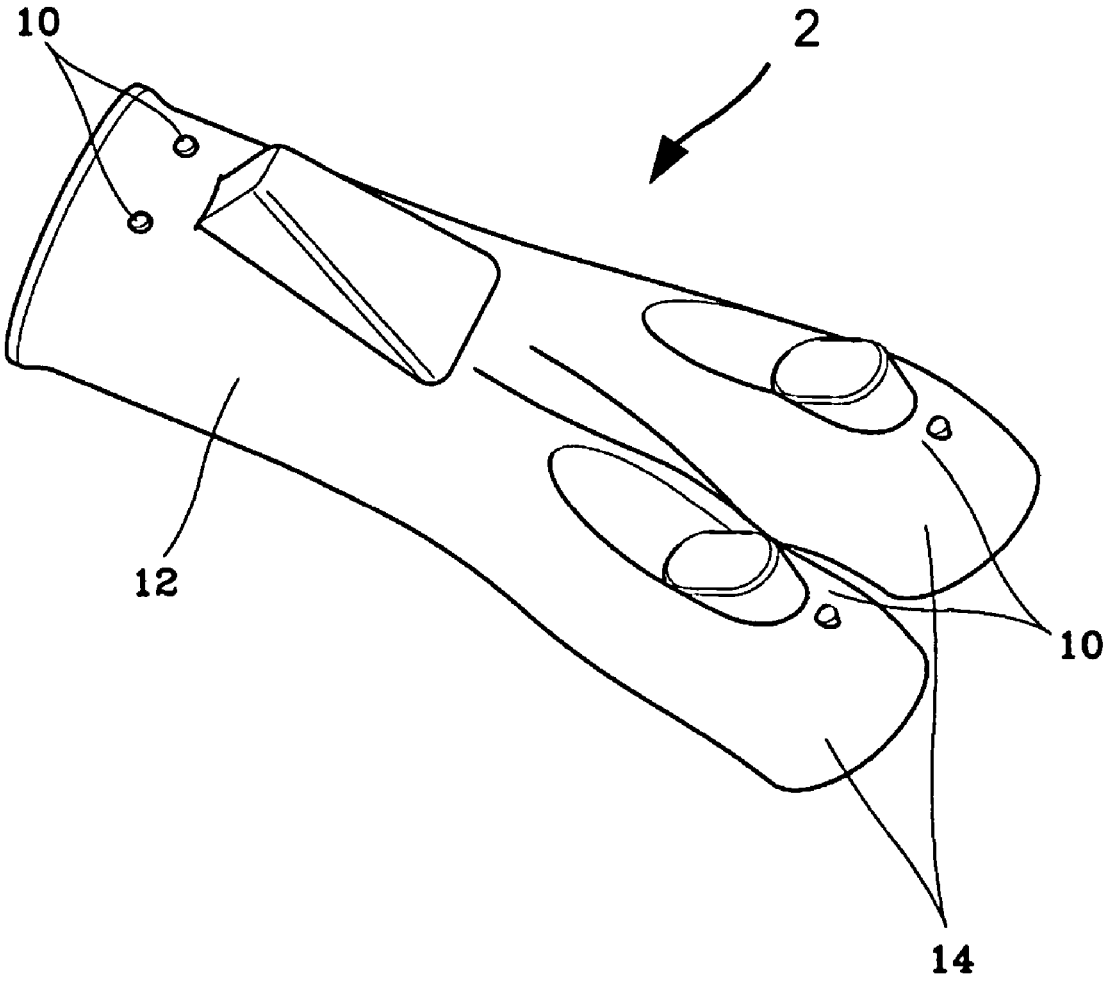
FIG. 1 is a perspective view of an intake or exhaust port molding core according to an embodiment of the present invention.
Figure 4:
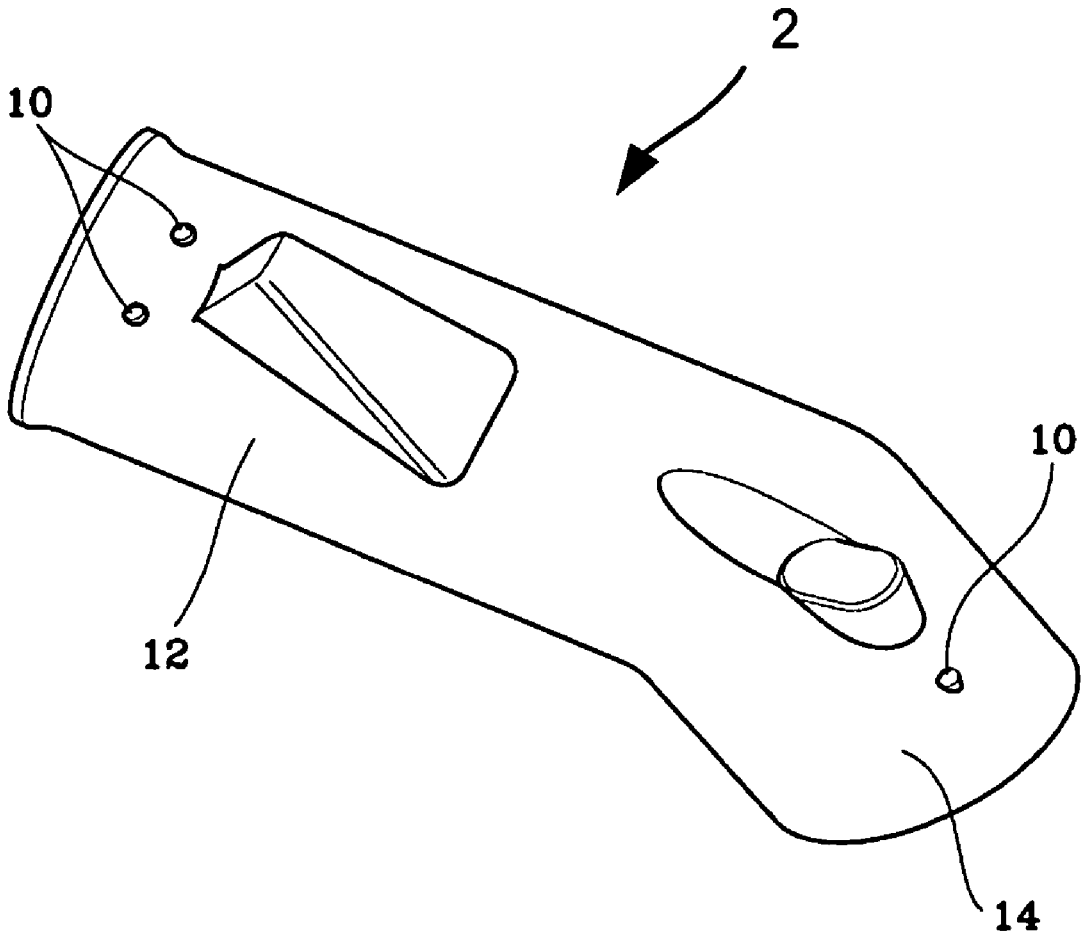
FIG. 4 is a perspective view of an intake or exhaust port molding core according to another embodiment of the present invention.

As illustrated in FIG. 1, a core 2, used to form an intake or exhaust port in a cylinder head includes a plurality of protruders 10. The plurality of protruders 10 provide standard points that designate the location of the intake or exhaust port to be formed inside the cylinder head. The core 2 of FIG. 1 is representative of a core used for an engine having four valves in one combustion chamber. The core includes a main body 12 and two subsidiary bodies 14. In the cylinder head mold, the main body 12 is disposed to connect to an intake or exhaust manifold while the two subsidiary bodies 14 branch out from the main body 12 and are disposed to connect with a combustion chamber of an engine. According to another embodiment, the core 2 as illustrated in FIG. 4 is representative of a core used in an engine having two valves in one combustion chamber. The core includes a main body 12 connecting to an intake or exhaust manifold in the cylinder head mold. A subsidiary body 14 extends from the main body 12 and is positioned to connect to the engine combustion chamber at the cylinder head mold.

Both cores in FIGS. 1 and 4 include the protruders 10. Hereinafter, the configuration of the cores will be described without specification of which type of engine the core is to be utilized with. Furthermore, it will be appreciated by one of ordinary skill in the art that the core can be readily adapted to be used as a core for molding an intake or an exhaust port.

The protruders 10 are preferably formed on the surface of the main body 12 in close proximity to a distal end thereof and form a connection with the intake or exhaust manifold. The protruders 10 are also formed at the surface of the subsidiary 14 in close proximity to a distal end thereof and form a connection with the engine combustion chamber.

According to another embodiment, the protruders 10 preferably integrally protrude from a plurality of sections on the core 2. Provided that the protruders 10 are formed on at least three sections of the core, the disposition of the intake or exhaust port in the cylinder head can be detected in three-dimensions after casting the cylinder head. That is, if one protruder is formed on the core, the disposition of the intake or exhaust port installed inside the cylinder head may be detected. If two protruders are formed, the disposition of the intake or exhaust port, as well as the inclination thereof, may be determined. Furthermore, if three or more protruders are present on the core 2, three dimensional information about the intake or exhaust port in relation to the cylinder head may be recognized.

The protruders 10 are formed on the surface of, or protrude from the surface of the main body 12 and subsidiary body 14 in close proximity to both distal ends thereof, respectively. According to this configuration a probe of a three dimensional instrument can be easily inserted into a depressed groove formed by the protruder following casting. The three dimensional determining instrument can then detect the sloping angle, orientation, and the like in relation to the intake or exhaust port.

Figure 2:
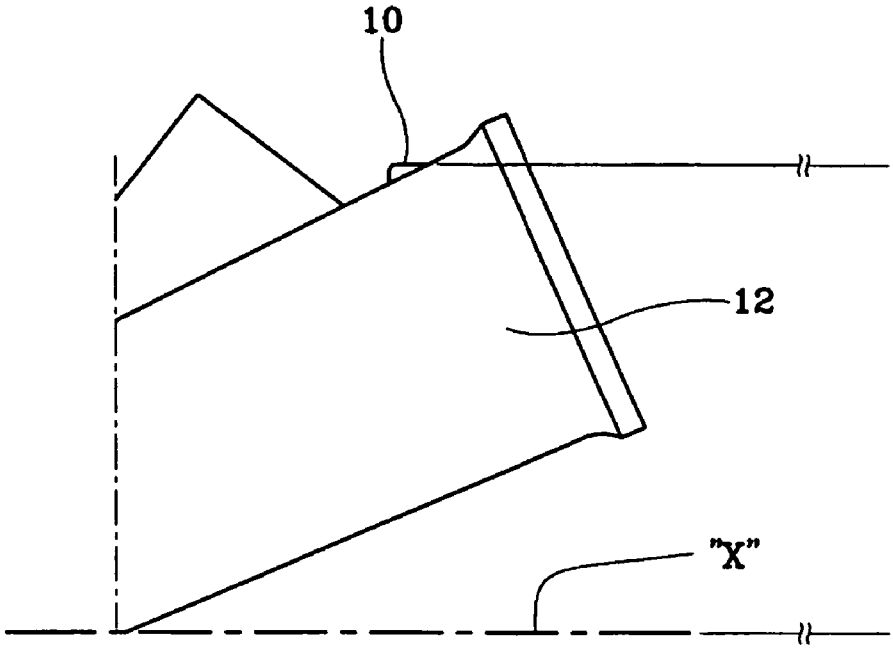
FIG. 2 illustrates a main body of the core of FIG. 1 for depicting a parallel relationship between a top surface of a protrusion and a bottom surface of a cylinder head, wherein the protruder is disposed on the main body and the bottom surface of the cylinder head becomes a standard surface after casting the cylinder head.
Figure 3:
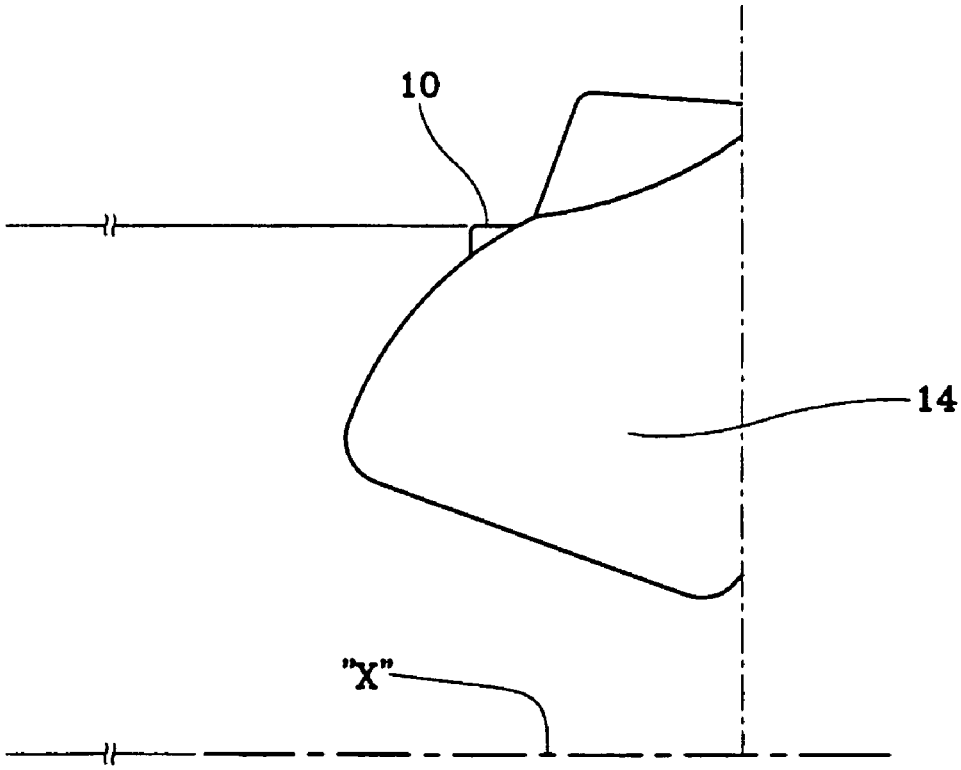
FIG. 3 illustrates a subbody of the core of FIG. 1 for depicting the parallel relationship between the top surface of a protruder and the bottom surface of the cylinder head, wherein the protruder is disposed on the subsidiary body and the bottom surface of the cylinder head becomes a standard surface after casting the cylinder head.

As shown in FIGS. 2 and 3, the protruders 10 are disposed on the main body 12 and subsidiary body 14 of the core 2, respectively. The top surface of the protruders 10 are preferably substantially parallel to the bottom surface (X) of the cylinder head in which the bottom surface (X) of the cylinder head is the standard surface of the cylinder head. Additionally the top surface of the protrusions is substantially a plane. Thus, an instrument can be used to accurately detect the disposition of the depressed groove of the intake or exhaust following casting.

The protruders 10 preferably form a cylindrical-shaped configuration having more than or equal to about 2.5 mm diameter. According to another embodiment, the protruders 10 form a polygonal-shaped configuration having more than or equal to 2.5 $mm^2$ sectional dimensions. The protruders are configured in such shapes and sizes in order for the probe of the three dimensional instrument to be easily inserted for detecting the orientation of the intake or exhaust port in the cylinder head.

The operation of the intake or exhaust port molding core structure according to the embodiment of the present invention will now described.

When the cylinder head is cast with the core 2 having the above structure, the core 2 having a main body 12 and a subsidiary body 14 forms the intake or exhaust port in the cylinder head during casting of the cylinder head. The protruders on the main body 12 and subsidiary body 14 form depressed groove within each intake or exhaust port. The depressed groove provides the disposition information of the intake or exhaust port in the cylinder head when a dimensional instrument is inserted into the depressed grooves for orientation determination. Therefore, the disposition of the intake or exhaust port may be determined by measuring the location of the depressed groove.

If one depressed groove is formed, the disposition of the intake or exhaust port in relation to the cylinder head can be determined. If two depressed grooves are formed, then the disposition of the intake or exhaust port and the inclination thereof in relation to the cylinder head can be determined. Furthermore, if three or more depressed grooves are formed, then the three dimensional information, namely the disposition, inclination, and orientation of the intake or exhaust port may be acquired. Therefore, the depressed grooves can be applied as a standard to accurately control the orientation, e.g., the inclination, in relation to the intake or exhaust port formed inside the cylinder head. Furthermore, because the orientation of the intake or exhaust port can be determined utilizing the depressed grooves there is no need to destroy cylinder heads by cutting them open to determine and test the orientation of the ports.

According to yet another embodiment, the invention includes a method of molding an intake or an exhaust port. The method includes molding an intake or exhaust port around a core structure wherein the core structure includes a main body having protrusions extending from the body. During molding, the protrusions form grooves in the newly molded intake and/or exhaust ports. Preferably the protrusions have a substantially flat or planer top surface. Following molding and removal of the core, the position of the intake or exhaust port can be determined by mapping the position of the grooves left behind by the protrusions.

As apparent from the foregoing, there is an advantage in that a plurality of protruders installed on the core form a plurality of depressed grooves in the intake or exhaust port of the cylinder head, and thus the disposition and orientation of the intake or exhaust port formed inside the cylinder head can easily and precisely be measured via the depressed grooves.

What is claimed is:

1. An intake or exhaust port molding core structure, comprising:

a main body that connects to an intake or exhaust manifold in a cylinder head mold;

a subsidiary body extending from said main body and positioned to connect with an engine combustion chamber in said cylinder head mold; and a plurality of protrusions integrally protruding out of a surface of said main body and said subsidiary body in close proximity to distal ends thereof, respectively, wherein a top surface of each of said protrusions is substantially parallel to a standard surface of said cylinder head.

2. The structure as defined in claim 1, wherein said protrusions are formed on a surface of said main body and said subsidiary body at distal ends thereof, respectively.

3. The structure as defined in claim 1, wherein each of said protrusions comprises a substantially cylindrical shape having more than or equal to about 2.5 mm diameter.

4. The structure as defined in claim 1, wherein each of said protrusions comprises a substantially polygonal surface having more than or equal to 2.5 $mm^2$ sectional area.

5. The structure as defined in claim 1, wherein said protrusions uniformly protrude out from at least three sections thereof at distal ends of said main body and front end surface of said subsidiary body.

6. An intake or exhaust port molding core structure, comprising:

a main body that connects to an intake or exhaust manifold in a cylinder head mold;

a plurality of subsidiary bodies branching from said main body and positioned to connect with an engine combustion chamber in said cylinder head mold; and a plurality of protrusions integrally protruding out of the surface of said main body and said subsidiary body at distal ends thereof, respectively, wherein a top surface of each of said protrusions is substantially parallel to a standard surface of said cylinder head.

7. The structure as defined in claim 6, wherein said protrusions are formed on a surface of said main body and said subsidiary body near a distal ends thereof, respectively.

8. The structure as defined in claim 6, wherein each of said protrusions comprises a substantially cylindrical shape having more than or equal to about 2.5 mm diameter.

9. The structure as defined in claim 6, wherein each of said protrusions comprises a substantially polygonal surface having more than or equal to 2.5 $mm^2$ sectional area.

10. The structure as defined in claim 6, wherein said protrusions uniformly protrude out from at least three sections on a surface of said main body and said subsidiary body at distal ends thereof.

11. An intake or exhaust port molding core structure, comprising:

a main body that connects to an intake or exhaust manifold in a cylinder head mold;

a subsidiary body extending from said main body and positioned to connect with an engine combustion chamber in said cylinder head mold; and a plurality of protrusions integrally protruding out of a surface of said main body and said subsidiary body in close proximity to distal ends thereof, respectively, wherein a top surface of each of said protrusions is substantially parallel to a standard surface of said cylinder head, wherein each of said protrusions comprises a substantially cylindrical shape having more than or equal to about 2.5 mm diameter.

12. An intake or exhaust port molding core structure, comprising:

a main body that connects to an intake or exhaust manifold in a cylinder head mold;

a plurality of subsidiary bodies branching from said main body and positioned to connect with an engine combustion chamber in said cylinder head mold; and a plurality of protrusions integrally protruding out of the surface of said main body and said subsidiary body at distal ends thereof, respectively, wherein a top surface of each of said protrusions is substantially parallel to a standard surface of said cylinder head, wherein each of said protrusions comprises a substantially cylindrical shape having more than or equal to about 2.5 mm diameter.

* * * * *